US007556595B2

(12) United States Patent
Van De Kruys et al.

(10) Patent No.: US 7,556,595 B2
(45) Date of Patent: Jul. 7, 2009

(54) METHOD AND DEVICE FOR THE PRODUCTION OF PACKAGING IN BAGS

(75) Inventors: Theo J. Van De Kruys, Weert (NL); Eduardo Friedmann, Veldhoven (NL); Peter Slenders, Maarheeze (NL)

(73) Assignee: Robert Bosch GmbH, Stuttgart (DE)

( * ) Notice: Subject to any disclaimer, the term of this patent is extended or adjusted under 35 U.S.C. 154(b) by 544 days.

(21) Appl. No.: 10/495,338

(22) PCT Filed: Oct. 18, 2002

(86) PCT No.: PCT/DE02/03948

§ 371 (c)(1),
(2), (4) Date: May 12, 2004

(87) PCT Pub. No.: WO03/047976

PCT Pub. Date: Jun. 12, 2003

(65) Prior Publication Data

US 2005/0014623 A1 Jan. 20, 2005

(30) Foreign Application Priority Data

Nov. 30, 2001 (DE) ..... 101 59 053

(51) Int. Cl.
*B31B 1/38* (2006.01)

(52) U.S. Cl. ..... 493/231; 493/244; 493/269; 493/447

(58) Field of Classification Search ..... 493/269, 493/231, 244, 447, 405, 455
See application file for complete search history.

(56) References Cited

U.S. PATENT DOCUMENTS

| | | | | |
|---|---|---|---|---|
| 5,570,569 | A * | 11/1996 | Masuda | 53/410 |
| 5,853,360 | A * | 12/1998 | Jeffrey et al. | 493/178 |
| 6,718,735 | B2 * | 4/2004 | Lewis et al. | 53/425 |

FOREIGN PATENT DOCUMENTS

| | | |
|---|---|---|
| DE | 1 113 174 | 8/1961 |
| DE | 1 807 453 | 1/1971 |
| DE | 19 539 832 A1 | 4/1997 |
| WO | WO 01/24 999 A1 | 4/2001 |

* cited by examiner

*Primary Examiner*—Christopher Harmon
(74) *Attorney, Agent, or Firm*—Ronald E. Greigg

(57) ABSTRACT

A method of and apparatus for producing bag packages with edge seals, in which a sheathing tube is formed from a packaging material sheeting. Before the sheathing tube is formed, sealing seams are formed in the packaging material sheeting.

12 Claims, 5 Drawing Sheets

FIG. 6
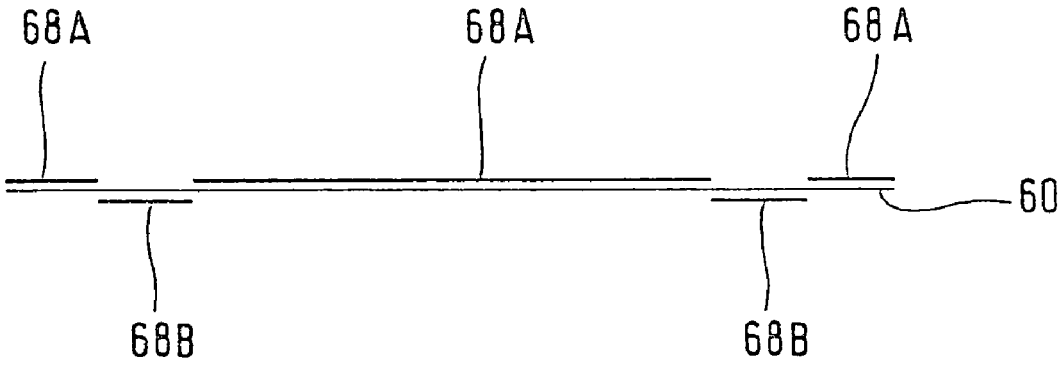
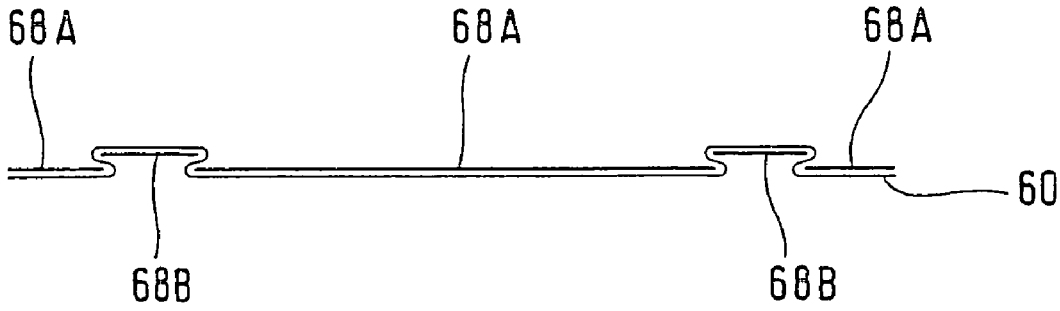
FIG. 7

METHOD AND DEVICE FOR THE PRODUCTION OF PACKAGING IN BAGS

CROSS-REFERENCE TO RELATED APPLICATIONS

This application is a 35 USC 371 application of PCT/DE02/03948 filed on Oct. 18, 2002.

BACKGROUND OF THE INVENTION

1. Field of the Invention

The invention relates to a method and an apparatus for producing bag packages.

2. Prior Art

Bag packages, in which foods such as powdered milk or flower, for instance, can be stored, are typically made from a sealable material, and have a base, in particular a block-type base suitable as a surface to stand on, and an angular, preferably rectangular cross section. To improve the stability of these bag packages, it is usual for the longest edges to be reinforced.

These edge reinforcements prevent deformation of the side walls and thus assure high dimensional stability of the bag package. The reinforcements for instance comprise sealing seams, which are produced by heat sealing in such a way that they need not perform any leakproofing function whatever. There are two common forms of bag; in one, the longitudinal seam is located centrally, and in the other it is located in the region of one edge. The longitudinal seam serves the purpose of stability and impermeability.

Apparatuses for producing these bag packages, known as tubular bag-making machines, form the bag packages with a rectangular cross section from packaging material sheeting. In one method step, the packaging material sheeting is folded over by a forming shoulder in such a way that a tube is produced. Next, in known methods, the edges are formed and sealed, so that the desired rectangular cross section is created and the bag package has the desired stability. Finally, the abutting edges are welded together, creating the longitudinal seam or longitudinal sealing seam.

German Patent 1 113 174 disclosure an apparatus for producing bag packages from one or more heat-sealable lengths of film in which feed devices are provided which comprise tongs or pairs of clamping jaws that can be raised and lowered. These elements are disposed such that the inside cross section of the forming mandrel is not altered by either the three-dimensional shape and disposition of the tongs nor their motion.

German Utility Model DE-GM 18 07 453 describes an apparatus for producing bag packages. In it, inside an optionally spreadable box form adapted to the initial bag cross section, edge strips adapted to the reduced bag cross section and extending preferably on both sides of the longitudinal edge of the bag are longitudinally displaceable and inserted with cushioning at the top. A pressure plate with heating plates pivotably connected to it that can be swivelled inward toward the bag walls can be pressed against the plate below the bag base. The lateral heating plates are pivotably connected and shaped in such a way that in cooperation with the edge strips located in the interior of the bag, the desired edge welding results at the base and at the side edges.

A disadvantageous aspect of known methods and apparatuses is that in the region downstream of the forming pipe, in which the edges are shaped and sealed, machine height is necessary.

SUMMARY AND ADVANTAGES OF THE INVENTION

The method of the invention for producing bag packages with sealed edges provides that a sheathing tube is formed from packaging material sheeting. It is distinguished in that before the sheathing tube is formed, the sealing seams are formed onto the sheeting material.

The apparatus according to the invention for producing bag packages includes a folding station for forming folds, a sealing station for sealing the formed folds, a packaging material driving station, and a forming station for forming the sheathing tube. The apparatus of the invention is distinguished in that the folding station and the sealing station are disposed such that the sealing seams are formed before the forming of the sheathing tube.

The folds are formed at the place in the packaging material sheeting at which the edges are provided later. Since the sealing seams are applied to the flat packaging material sheeting, substantial machine height is not necessary in this region. Advantageous refinements of the invention will become apparent from the description below.

In an advantageous feature of the invention, between the folding station and the sealing station, a feed roller is provided, with which the packaging material is deflected at a right angle. This assures that edge sealing with uniform seam width can be achieved. The feed roller has the effect that the folds are bent with sharp edges and can therefore be sealed afterward with a constant seam width.

For forming the folds into the packaging material sheeting, it is attractive to provide folding plates or metal plates. These metal plates can easily be replaced. Thus the apparatus can be designed for different sizes of bag. Either three or four folds are formed, depending on whether the later longitudinal sealing seam, which is welded in the course of the forming of the sheathing tube, will be located in the region of one edge.

It is advantageous if the forming station has a forming pipe and a forming shoulder, which are already known from conventional tubular bag-making machines.

A guide plate disposed below the forming shoulder assures that the edge seals will be given the desired orientation.

In a feature of the invention, the sealing station comprises at least one heatable sealing jaw and an anvil jaw.

The at least one sealing jaw is typically disposed below the packaging material sheeting, and the anvil jaw is typically disposed on its top. It is advantageous in this respect if the anvil jaw is likewise heatable.

If the lower sealing jaw is pneumatically driven, the possibility exists, with the packaging material stopped, of pulling away the heated sealing jaw without delay, to avoid heat damage. The sealing pressure is adjusted with compression springs via the lower jaws.

BRIEF DESCRIPTION OF THE DRAWINGS

The invention will be described in further detail herein below, in conjunction with the accompanying drawings, in which:

FIG. 6 shows a section taken along the line VI-VI in FIG. 5.

FIG. 7 shows a section taken along the line VII-VII in FIG. 5.

DESCRIPTION OF THE PREFERRED EMBODIMENTS

Figure 1A:
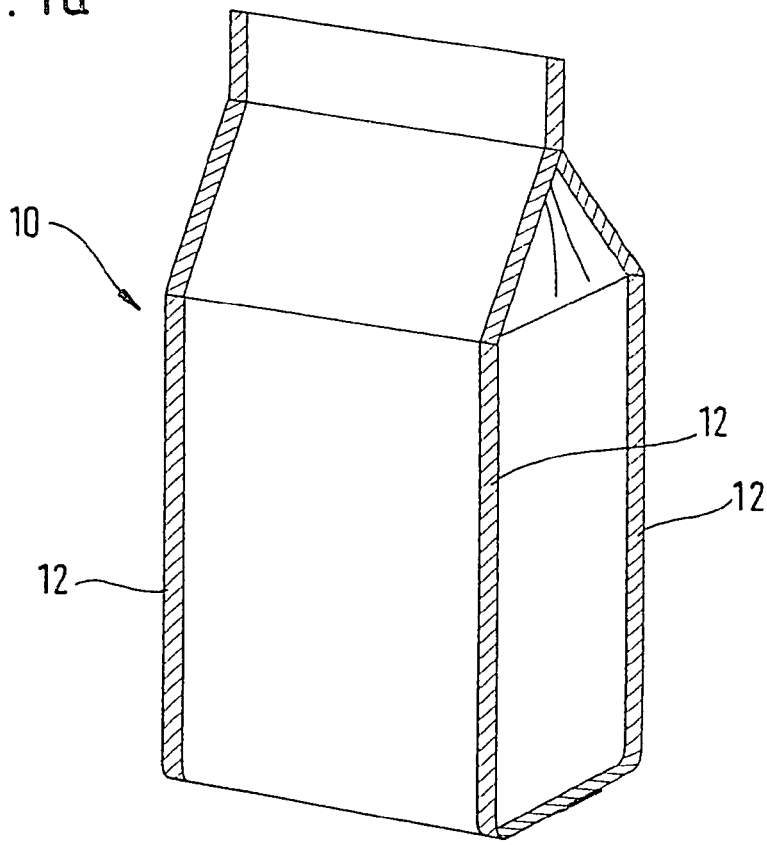
FIG. 1*a* shows a bag package with a longitudinal seam extending along the edge, in perspective.

In FIG. 1*a*, a bag package is shown, identified overall by reference numeral 10. The edges of the bag package 10 have sealing seams 12 which assure the stability of the bag package 10. One of the sealing seams 12 represents the longitudinal seam.

Figure 1B:
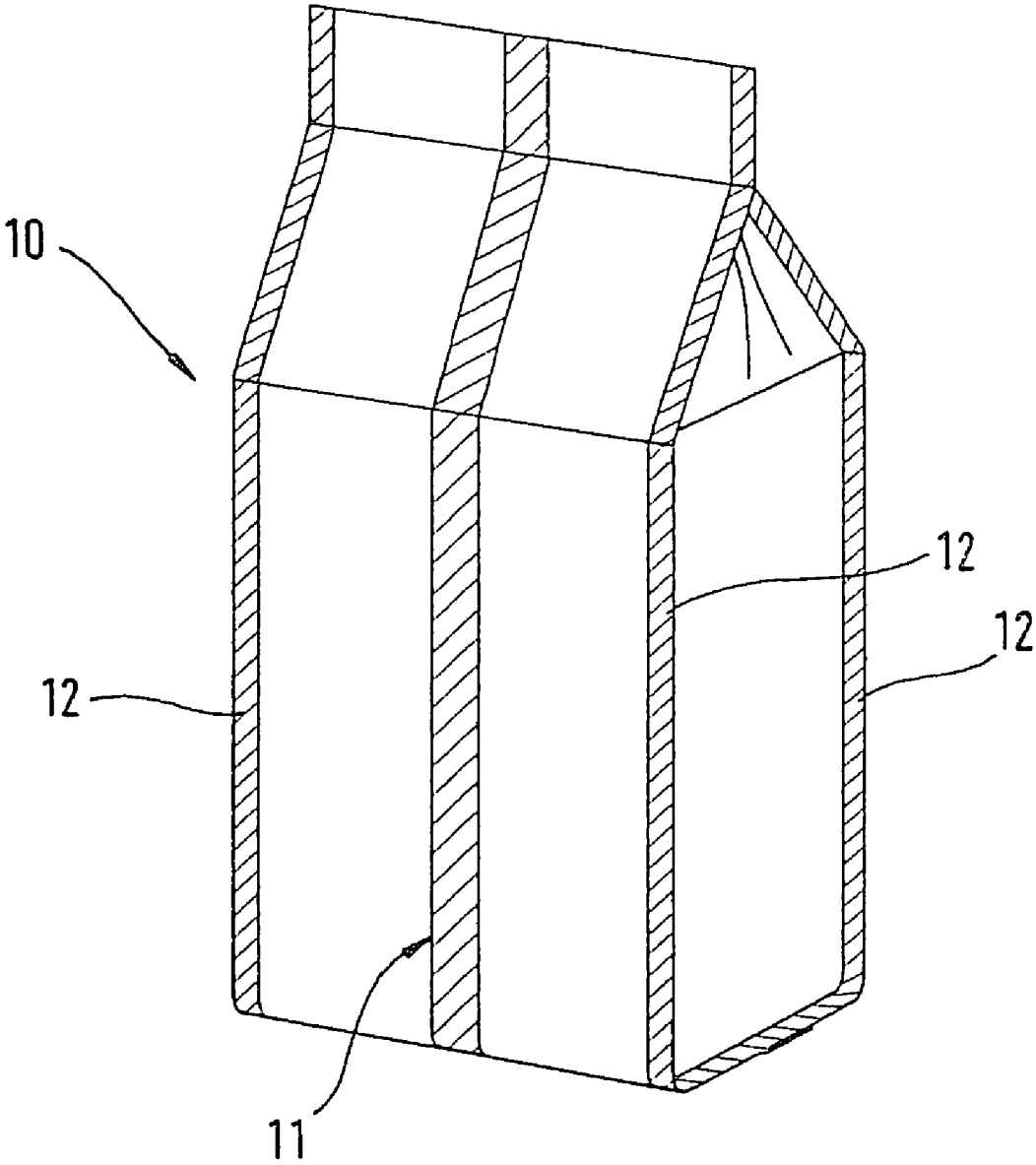
FIG. 1*b* shows a bag package with a centrally extending longitudinal seam, in perspective.

In FIG. 1*b*, the bag package 10 is shown with a centrally extending longitudinal seam 11 and four sealing seams 12 that form the edges of the bag package 10.

Figure 2:
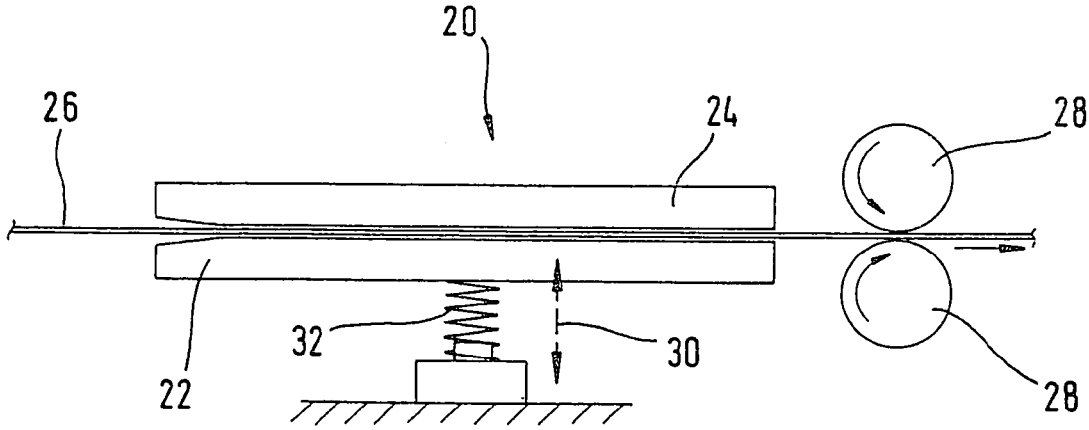
FIG. 2 shows a sealing station schematically.

FIG. 2 shows a sealing station 20 schematically. The sealing station 20 includes a heatable sealing jaw 22 and above it an anvil jaw 24. Packaging material sheeting 26 is passed between the sealing jaw 22 and the anvil jaw 24 by means of two driven rolling cylinders 28, and the folds already formed in the packaging material sheeting 26 are sealed in the process.

The sealing jaw 22 is driven pneumatically in the direction of a double arrow 30. The sealing pressure is adjusted via a compression spring 32.

Figure 3:
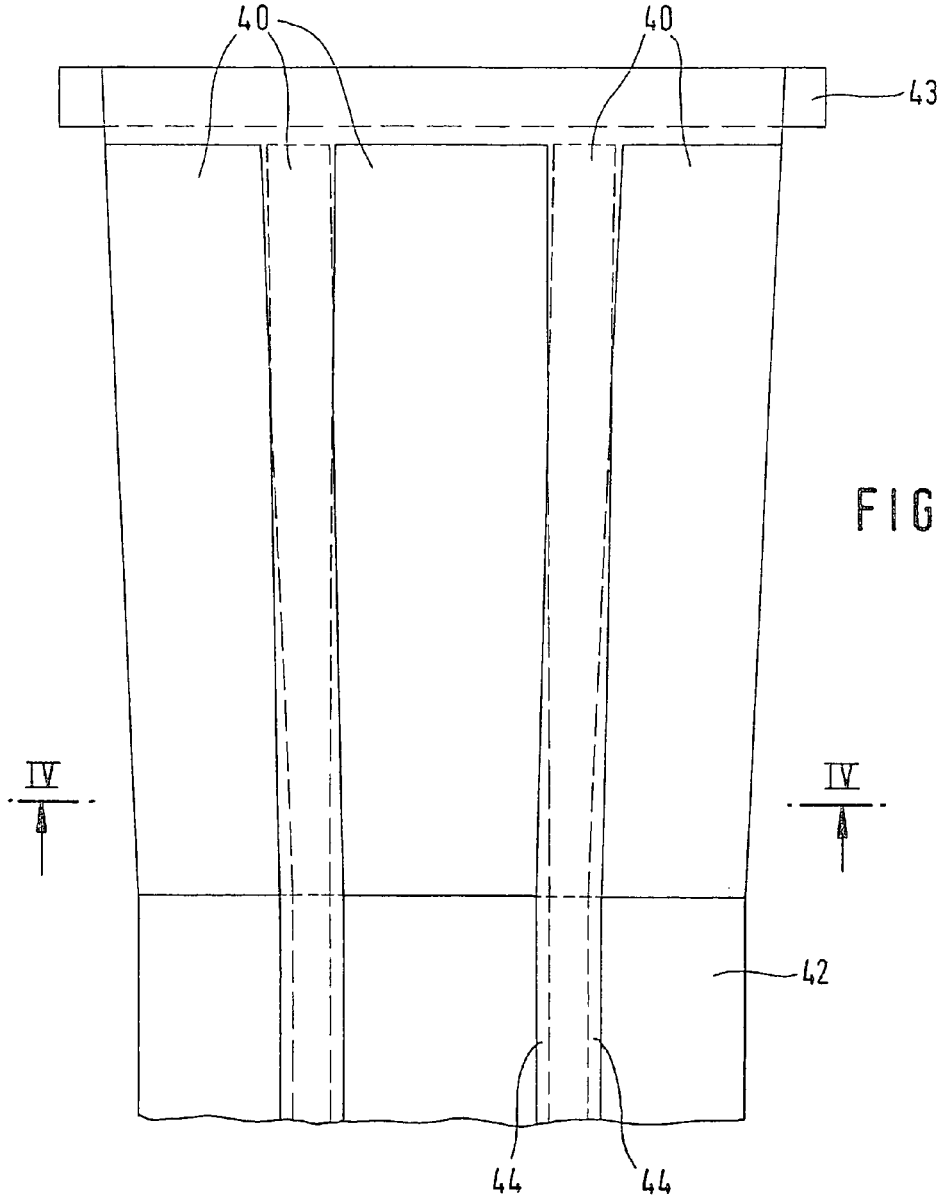
FIG. 3 shows metal plates for forming folds.

In FIG. 3, metal plates 40 for forming the folds are shown. Packaging material sheeting 42 is passed between these metal plates 40 for forming the folds. In the process, the packaging material sheeting 42 is deflected via a roller 43.

The metal plates 40 cause folds 44 to be formed at predetermined points in the packaging material sheeting 42.

Figure 4:
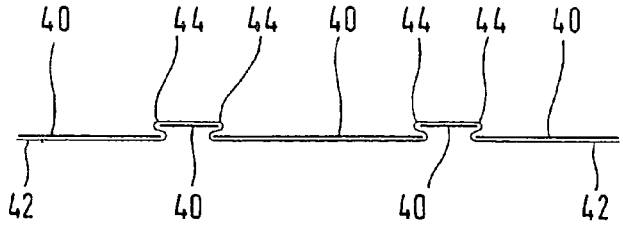
FIG. 4 shows a section taken along the line IV-IV in FIG. 3.

FIG. 4 shows a section taken along the line IV-IV in FIG. 3. Once again, the metal plates 40 can be seen. The packaging material sheeting 42 is located between the metal plates 40 and has folds 44 in predetermined regions.

Figure 5:
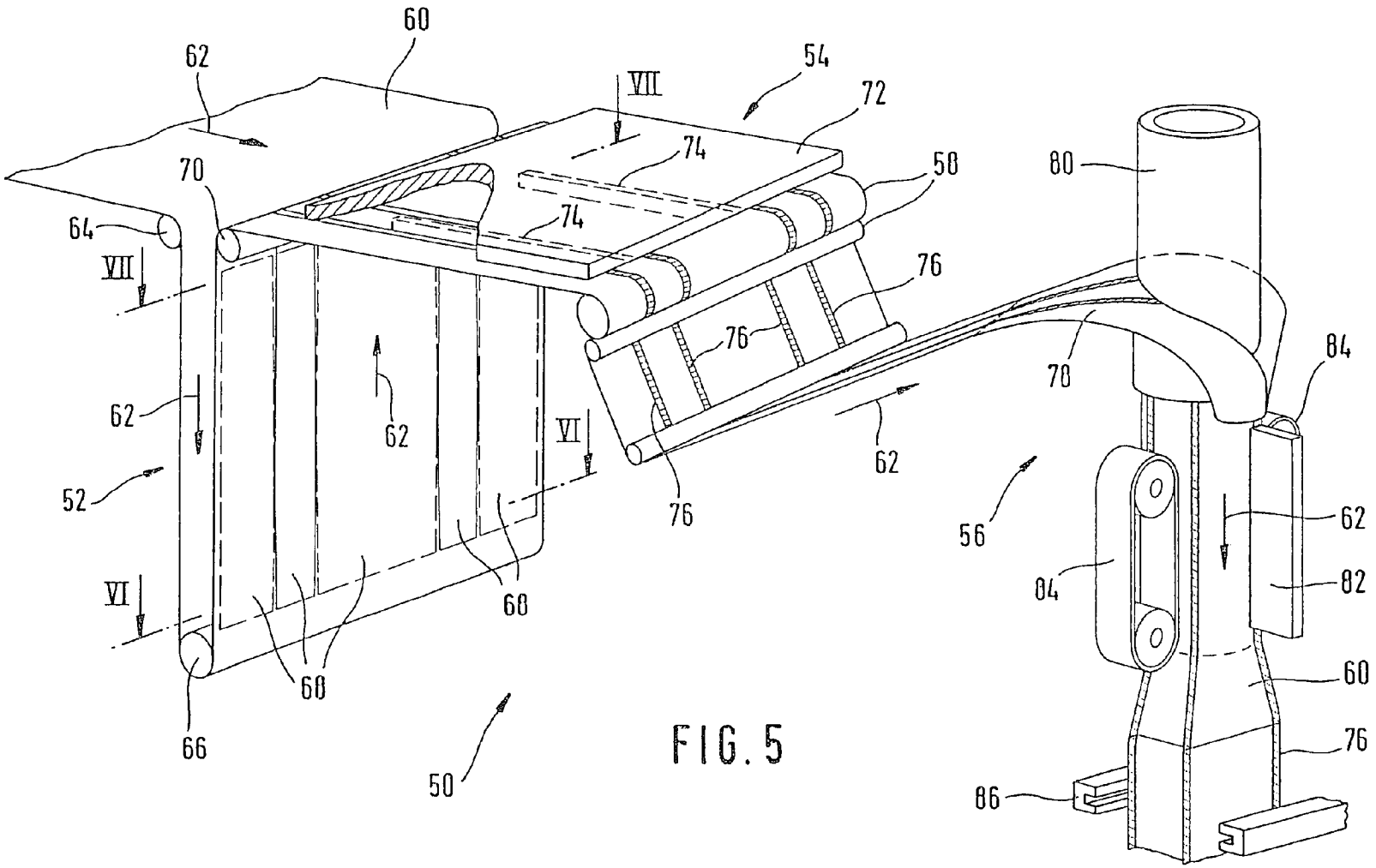
FIG. 5 shows a preferred embodiment of the apparatus according to the invention for producing bag packages, in perspective.

In FIG. 5, an apparatus according to the invention for producing bag packages, which is a so-called tubular bag-making machine 50, is shown. This machine includes a folding station 52, a sealing station 54, a forming station 56, and a driven pair of contact-pressure rollers 58 serving as a packaging material driving station. In the tubular bag-making machine 50, a packaging material sheeting 60 is transported for processing. Arrows 62 indicate the travel direction of the packaging material sheeting 60.

The packaging material sheeting 60 is first deflected via a deflection roller 64 and guided downward to an inlet roller 66. Next, the packaging material sheeting 60 is passed between metal plates 68, for forming the folds in the packaging material sheeting 60. The metal plates 68 correspond to the metal plates 40 in FIG. 4. A feed roller 70 deflects the packaging material sheeting 60 once again before the sheeting is guided through the sealing station 54. The sealing station 54 includes an anvil jaw 72 and sealing jaws 74, which correspond to jaws 20, 22, respectively, are disposed in the region of the folds in the packaging material sheeting 60, so that these folds are sealed.

Next, the packaging material sheeting 60, which now has sealing seams 76, is transported onward via the driven pair of contact-pressure rollers 58 to the forming station 56.

The forming station 56 includes a forming shoulder 78 and a forming pipe 80. In the forming station 56, a sheathing tube is formed from the packaging material sheeting 60. In the process, the abutting edges of the packaging material sheeting 60 are welded with a longitudinal seam sealing jaw 82.

For transporting the packaging material sheeting 60 or sheathing tube, two packaging material conveyor belts 84 are used. The transverse seams are sealed with transverse-seam sealing jaws 86.

In FIG. 6, a section taken along the line VI-VI in FIG. 5 is shown. The metal plates 68 from FIG. 5 can be seen, namely three first metal plates 68A and two second metal plates 68B. The packaging material sheeting 60 is passed between these metal plates 68. The first metal plates 68A are disposed above the second metal plates 68B in FIG. 6 in such a way that the flat packaging material sheeting 60 can be passed between them.

In FIG. 7, a section taken along the line VII-VII in FIG. 5 is shown. Once again, the first metal plates 68A and the second metal plates 68B and the packaging material sheeting 60 that is passed between them are shown. It can be seen in this view that the second metal plates 68B are now located above the first metal plates 68A. The position of the first metal plates 68A relative to the position of the second metal plates 68B is thus altered, in comparison to those of FIG. 6.

The first metal plates 68A are thus oriented relative to the second metal plates 68B such that in the region shown in FIG. 6, the first metal plates 68A are located above the second metal plates 68B, and in the region shown in FIG. 7, the first metal plates 68A are located below the second metal plates 68B. Thus the metal plates 68 do not extend parallel to one another.

Upon entry of the packaging material sheeting 60 into the folding station 52, the first metal plates 68A are located above the second metal plates 68B. In the conveying direction 62 of the packaging material sheeting 60, the second metal plates 68B are now oriented or inclined relative to the first metal plates 68*a* in such a way that in the downstream region in terms of the conveying direction 62, these second metal plates are located above the first metal plates 68*a*. The effect is that the packaging material sheeting 60 passed between the metal plates 68 is folded at the places intended for that.

The folds are then sealed in the sealing station 54 and later form the sealed edges, that is, the sealing seams 76 of the bag package.

The foregoing relates to preferred exemplary embodiments of the invention, it being understood that other variants and embodiments thereof are possible within the spirit and scope of the invention, the latter being defined by the appended claims.

The invention claimed is:

1. An apparatus for producing bag packages (10), from a length of packaging material, the apparatus comprising a folding station (52) for forming folds (44) in a moving sheet of packaging material, a sealing station (54) downstream of the folding station for sealing the formed folds (44), a packaging material driving station (58) downstream of the sealing station, and a forming station (56) for forming a sheathing tube from the packaging material, whereby before the sheathing tube is formed, the forming of the sealing seams (12, 76) onto the packaging material sheeting (26, 42, 60) is done, said folding station (52) comprising at least two folding plates (40; 68A, 68B) disposed side by side in the travel direction of the length of packaging material in such a manner that at least two adjacent side edges, disposed side by side, of the folding plates (40; 68A; 68B) are oriented parallel to the travel direction of the length of packaging material; wherein the packaging material is guided along the underside of a first of said folding plates (40; 68A) and along the top of a second of said folding plates (40; 68B) by said at least two adjacent side edges, further comprising a feed roller (70) between the folding station (52) and the sealing station (54).

2. An apparatus for producing bag packages (10), from a length of packaging materials, the apparatus comprising a folding station (52) for forming folds (44) in a moving sheet of packaging material, a sealing station (54) downstream of the folding station for sealing the formed folds (44), a packaging material driving station (58) downstream of the sealing station, and a forming station (56) for forming a sheathing tube from the packaging material, whereby before the sheathing tube is formed, the forming of the sealing seams (12, 76) onto the packaging material sheeting (26, 42, 60) is done, said folding station (52) comprising at least two folding plates (40; 68A, 68B) disposed side by side in the travel direction of the length of packaging material in such a manner that at least two adjacent side edges, disposed side by side, of the folding plates (40; 68A; 68B) are oriented parallel to the travel direction of the length of packaging material; wherein the packaging material is guided along the underside of a first of said folding plates (40; 68A) and along the top of a second of said folding plates (40; 68B) by said at least two adjacent side edges, wherein the forming station (56) comprises a forming pipe (80) and a forming shoulder (78).

3. The apparatus of claim 2, wherein the forming station (56) comprises a forming pipe (80) and a forming shoulder (78).

4. An apparatus for producing bag packages (10), from a length of packaging material, the apparatus comprising a folding station (52) for forming folds (44) in a moving sheet of packaging material, a sealing station (54) downstream of the folding station for sealing the formed folds (44), a packaging material driving station (58) downstream of the sealing station, and a forming station (56) for forming a sheathing tube from the packaging material, whereby before the sheathing tube is formed, the forming of the sealing seams (12, 76) onto the packaging material sheeting (26, 42, 60) is done.

said folding station (52) comprising at least two folding plates (40; 68A, 68B) disposed side by side in the travel direction of the length of packaging material in such a manner that at east two adjacent side edges, disposed side by side, of the folding plates (40; 68A; 68B) are oriented parallel to the travel direction of the length of packaging material; wherein the packaging material is guided along the underside of a first of said folding plates (40; 68A) and along the top of a second of said folding plates (40; 68B) by said at least two adjacent side edges, further comprising a guide plate below the forming station (56).

5. The apparatus of claim 1, further comprising a guide plate below the forming station (56).

6. The apparatus of claim 2, further comprising a guide plate below the forming station (56).

7. An apparatus for producing bag packages (10), from a length of packaging material, the apparatus comprising a folding station (52) for forming folds (44) in a moving sheet of packaging material, a sealing station (54) downstream of the folding station for sealing the formed folds (44), a packaging material driving station (58) downstream of the sealing station, and a forming station (56) for forming a sheathing tube from the packaging material, whereby before the sheathing tube is formed, the forming of the sealing seams (12, 76) onto the packaging material sheeting (26, 42, 60) is done, said folding station (52) comprising at least two folding plates (40; 68A, 68B) disposed side by side in the travel direction of the length of packaging material in such a manner that at least two adjacent side edges, disposed side by side, of the folding plates (40; 68A; 68B) are oriented parallel to the travel direction of the length of packaging material; wherein the packaging material is guided along the underside of a first of said folding plates (40; 68A) and along the top of a second of said folding plates (40; 68B) by said at least two adjacent side edges, wherein the sealing station (54) comprises at least one heatable sealing jaw (22, 74) and an anvil jaw (24, 72).

8. The apparatus of claim 1, wherein the sealing station (54) comprises at least one heatable sealing jaw (22, 74) and an anvil jaw (24, 72).

9. The apparatus of claim 2, wherein the sealing station (54) comprises at least one heatable sealing jaw (22, 74) and an anvil jaw (24, 72).

10. The apparatus of claim 7, wherein the anvil jaw (24, 72) is heatable.

11. The apparatus of claim 7, wherein the at least one sealing jaw (22, 74) is driven pneumatically.

12. The apparatus of claim 10, wherein the at least one sealing jaw (22, 74) is driven pneumatically.

* * * * *